United States Patent [19]

Le

[11] 4,413,638

[45] Nov. 8, 1983

[54] SAFETY CIGARETTE BOTTLE

[76] Inventor: Be V. Le, 912 S. Ter., Wichita, Kans. 67218

[21] Appl. No.: 359,690

[22] Filed: Mar. 19, 1982

[51] Int. Cl.[3] ..... A24F 13/16; A24F 13/22; A24F 13/12; A24F 13/14

[52] U.S. Cl. ..... 131/174; 131/329; 131/178; 131/185; 131/187; 131/190; 131/231; 131/198 R

[58] Field of Search ..... 131/187, 329, 185, 330, 131/178, 249, 231, 174, 90, 198 R, 175, 198 A

[56] References Cited

U.S. PATENT DOCUMENTS

| | | | |
|---|---|---|---|
| 3,805,806 | 4/1974 | Grihalva | 131/175 |
| 3,918,464 | 11/1975 | Kolodziej | 131/175 |
| 3,955,585 | 5/1976 | Fox | 131/175 |
| 4,061,149 | 12/1977 | Raczkowski | 131/175 |
| 4,172,460 | 10/1979 | Robertson | 131/175 |
| 4,198,992 | 4/1980 | Smith | 131/175 |
| 4,216,786 | 8/1980 | Wright | 131/329 |
| 4,236,539 | 12/1980 | Mosby, Jr. | 131/175 |

*Primary Examiner*—V. Millin

*Attorney, Agent, or Firm*—Edwin H. Crabtree

[57] ABSTRACT

A safety cigarette bottle for smoking cigarettes or the like. The bottle provides for safely smoking a cigarette to prevent a potential building fire and provides for clean housekeeping while smoking. The bottle includes a cigarette lighter with lighter chamber for lighting the cigarette. A cigarette holder is slidably mounted in a cigarette chamber for receiving the cigarette therein. An ash tray chamber is releasably attached to the bottom of the cigarette chamber for receiving and removing the cigarette ashes.

7 Claims, 4 Drawing Figures

SAFETY CIGARETTE BOTTLE

BACKGROUND OF THE INVENTION

This invention relates to a device for smoking a cigarette safely therein and more particularly but not by way of limitation to a safety cigarette bottle having a cigarette holder slidably mounted in a cigarette chamber for receiving and smoking a cigarette in the chamber.

Heretofore, there have been various types of cigarette and cigar holders in combination with ash trays. These holders are described in U.S. Pat. Nos. 1,483,503 to Boreiko, 1,868,011 to Haas, 2,177,636 to Coffelt et al, 2,400,847 to Smith, 2,541,837 to Schroff, 3,543,768 to Law, 4,289,149 to Kyriakou. None of the above prior art patents specifically disclose the combination of a flexible mouth piece with a cigarette holder received in a cigarette chamber, a lighter chamber and an ash tray chamber for receiving the ashes when the cigarette is smoked inside the cigarette chamber.

SUMMARY OF THE INVENTION

The subject safety cigarette bottle provides for safely smoking cigarettes or the like to prevent a potential building fire and provide for clean housekeeping while smoking.

The cigarette bottle may be hung around the neck of the user of the cigarette bottle or it may be placed on a horizontal surface such as a table. When using the cigarette bottle the user is free to use his hands while working.

The cigarette bottle provides for holding the cigarette in a cigarette holder having a flexible tube and mouth piece. A cigarette chamber is used for receiving a cigarette therein and smoking. The bottle also provides for a lighter in a lighter chamber for lighting the cigarette and an ash tray chamber for receiving the ashes when the cigarette is smoked.

The safety cigarette bottle for smoking a cigarette or the like includes a cigarette holder adapted for holding a cigarette. The cigarette holder is slidably mounted in a cigarette chamber. A mouth piece with a flexible smoking tube is connected to the holder for drawing smoke from the cigarette. A cigarette lighter is hinged in a lighter chamber. The lighter chamber is attached to the front of the cigarette chamber. An ash tray chamber is communicably connected to the bottom of the cigarette chamber and releasably attached for receiving the ashes from the cigarette and removing the ashes when the ash tray chamber is full.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
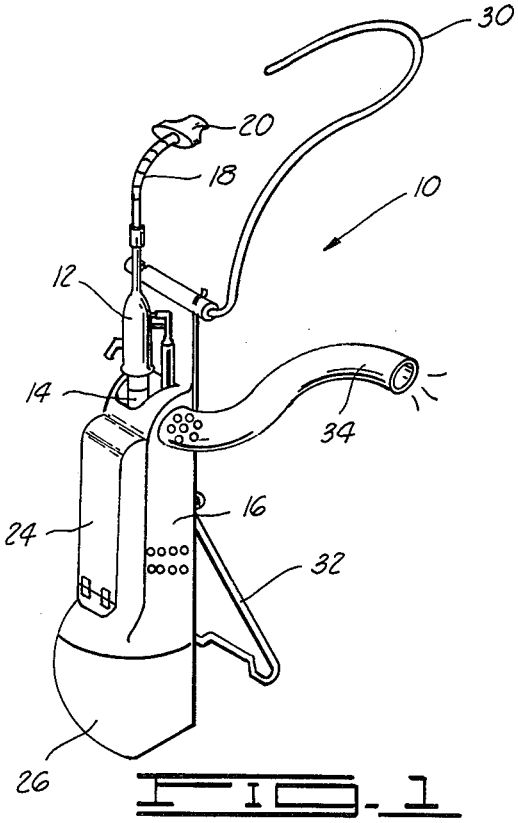
FIG. 1 is a perspective view of the safety cigarette bottle.
Figure 3:
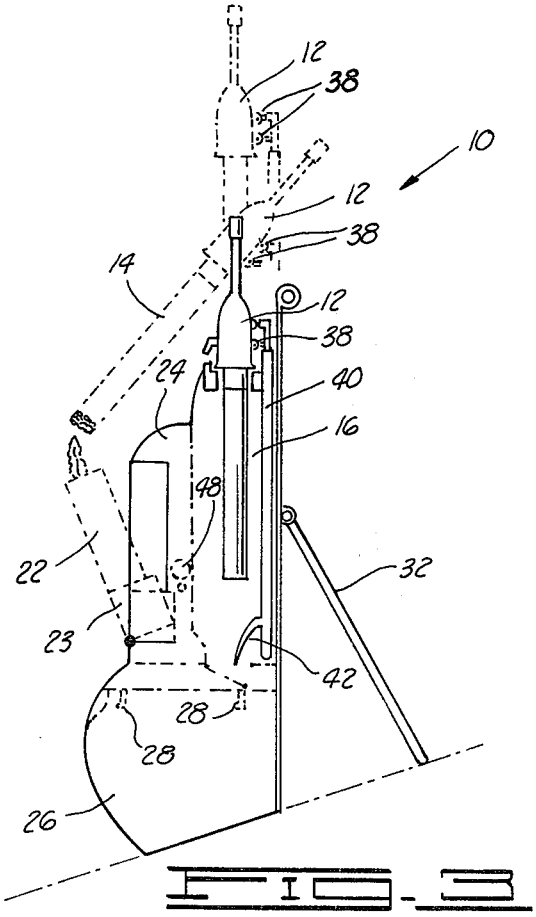
FIG. 3 is a side view of the safety cigarette bottle showing the cigarette being lit by the cigarette lighter.
Figure 4:
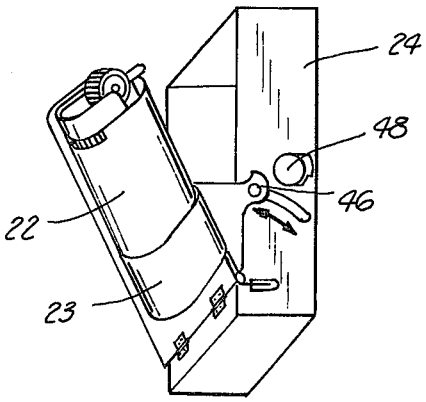
FIG. 4 is an enlarged view of the cigarette lighter hinged in a lighter chamber.

In FIG. 1, the safety cigarette bottle is designated by general reference numeral 10. The bottle 10 boardly includes a cigarette holder 12 adapted for holding a cigarette 14. The holder 12 is slidably mounted in a cigarette chamber 16. A flexible smoking tube 18 is communicably connected to the top of the cigarette holder 12 with the other end of the tube 18 attached to a mouth piece 20. A cigarette lighter 22 with lighter holder 23 is shown in FIGS. 3 and 4 and is hinged in the lighter chamber 24 attached to the front of the cigarette chamber 16. An ash tray chamber 26 is communicably connected to the bottom of the cigarette chamber 16 for receiving the ashes from the cigarette 14. The ash tray chamber 26 is releasably attached to the bottom of the lighter chamber 16 by clips 28 as shown in FIG. 3.

The safety cigarette bottle 10 may be held around the user of the bottle 10 by a neck hanger 30 which is attached at both ends to the top of the cigarette chamber 16. Also, when the neck hanger 30 is not required, the bottle 10 may be placed on a flat horizontal surface using a stand 32 as shown in FIG. 3.

If desired, a flexible exhaust tube 34 may be connected to the side of the cigarette chamber 16 for directing smoke away from the user of the bottle 10.

Figure 2:
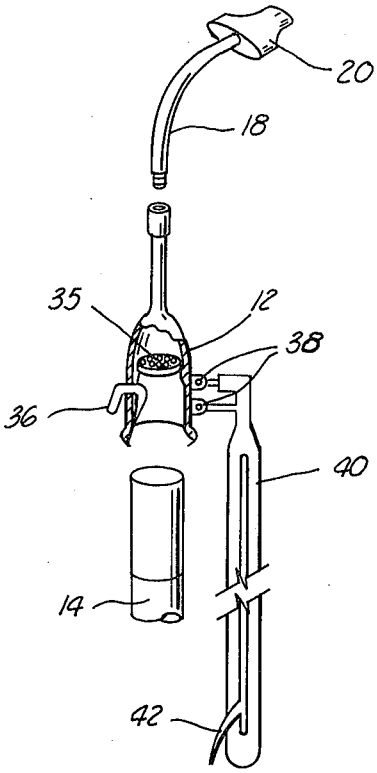
FIG. 2 is an enlarged side view of the cigarette holder with flexible smoking tube and mouth piece.

In FIG. 2 an enlarged side view of the cigarette holder 12 can be seen. The top of the cigarette holder 12 includes a screen 35 for drawing smoke therethrough and into the flexible smoking tube 18. The holder 12 also includes a clip lever 36 which is used to remove the end of the cigarette 14 when the cigarette 14 has been completely smoked. The holder 12 is hinged by hinges 38 to an elongated slide member 40 having at the opposite end an ash tray checking lever 42 which is received into the top of the ash tray chamber 26 as shown in FIG. 3. The slide member 40 is slidably received inside the cigarette chamber 16 with the cigarette 14 smoked therein. The hinges 38 allow the holder 12 to be angled outwardly for lighting the cigarette 14. The holder 12 with cigarette 14 is shown in dotted lines when moved upwardly out of the chamber 16 for lighting the cigarette 14.

In FIG. 4 an enlarged view of the lighter 22 and lighter chamber 24 can be seen with the lighter holder 23 having a lock hook 46 which engages a hook release button 48. The release button 48 is spring biased and by pushing the button 48 inwardly the lock hook 46 is released so the lighter holder 23 hinged to the lighter chamber 24 can be moved outwardly for lighting the cigarette 14 as shown in FIG. 3.

Changes may be made in the construction and arrangement of the parts or elements of the embodiments as described herein without departing from the spirit or scope of the invention defined in the following claims.

What is claimed is:

1. A safety cigarette bottle for smoking a cigarette or the like, the bottle comprising:

a cigarette holder adapted for holding a cigarette, the holder pivotally attached to a slide member, the slide member slidably mounted in a cigarette chamber;

a mouth piece with flexible smoking tube connected to the cigarette holder for drawing smoke from the cigarette;

a cigarette lighter hingably mounted in a lighter chamber, the lighter chamber attached to the front of the cigarette chamber, and an ash tray chamber communicably connected to the bottom of the cigarette chamber, the ash tray chamber releasably attached to the bottom of the cigarette chamber for removing the ashes from the cigarette.

2. The cigarette bottle as described in claim 1 further including a neck hanger attached to the top of the cigarette chamber for holding the bottle adjacent the user of the bottle.

3. The cigarette bottle as described in claim 1 further including a stand attached to the cigarette chamber for holding the cigarette bottle on a horizontal surface.

4. The cigarette bottle as described in claim 1 further including smoke exhaust holes in the side of the cigarette chamber.

5. The cigarette bottle as described in claim 1 wherein the cigarette holder includes a clip lever mounted therein, the clip lever used to remove the cigarette therefrom.

6. The cigarette bottle as described in claim 1 further including smoke exhaust holes in the side of the cigarette chamber with a flexible exhaust tube connected thereto for directing the smoke away from the user of the bottle.

7. The cigarette bottle as described in claim 6 wherein the slide member includes an ashtray checking lever at one end thereof, the ashtray checking lever having a portion received inside the ashtray chamber for determining when the ashtray chamber is full, the slide member slideably received in the cigarette chamber.

* * * * *